US005380173A

United States Patent [19]

Hellstrom

[11] Patent Number: 5,380,173

[45] Date of Patent: Jan. 10, 1995

[54] PERISTALTIC PUMP

[75] Inventor: Steven P. Hellstrom, Roselle, Ill.

[73] Assignee: Cole-Parmer Instrument Company, Niles, Ill.

[21] Appl. No.: 123,807

[22] Filed: Sep. 20, 1993

[51] Int. Cl.[6] ..... F04B 43/08

[52] U.S. Cl. ..... 417/477.3; 417/477.11

[58] Field of Search ..... 417/474, 477, 477 B, 417/477 J

[56] References Cited

U.S. PATENT DOCUMENTS

| | | | |
|---|---|---|---|
| 3,963,023 | 6/1976 | Hankinson . | |
| 4,231,725 | 11/1980 | Hogan . | |
| 4,256,442 | 3/1981 | Lamadrid et al. | 417/477 |
| 4,493,706 | 1/1985 | Borsanyi et al. | 417/474 |
| 4,552,516 | 11/1985 | Stanley | 417/477 |
| 4,813,855 | 3/1989 | Leveen et al. | 417/477 |
| 4,886,431 | 12/1989 | Soderquist et al. . | |
| 5,082,429 | 1/1992 | Soderquist et al. . | |
| 5,110,270 | 5/1992 | Morrick . | |
| 5,133,650 | 7/1992 | Sunderland et al. . | |
| 5,147,312 | 9/1992 | Walker et al. . | |
| 5,230,614 | 7/1993 | Zanger et al. | 417/477 |
| 5,266,013 | 11/1993 | Aubert et al. | 417/477 |

FOREIGN PATENT DOCUMENTS

| | | | |
|---|---|---|---|
| 2051253 | 1/1981 | United Kingdom | 417/477 |
| 2075128 | 11/1981 | United Kingdom | 417/477 |

OTHER PUBLICATIONS

Information regarding properties of plastic materials (author unknown; title unknown; date unknown; pp. 1, 2, 6, 13 and 14).

*Primary Examiner*—Richard A. Bertsch
*Assistant Examiner*—M. Kocharov
*Attorney, Agent, or Firm*—Fitch, Even, Tabin & Flannery

[57] ABSTRACT

A peristaltic pump constructed of a relatively small number of components so that performance and reliability criteria can be satisfied in a relatively economical and compact pump. In a preferred embodiment, the occlusion bed pivots about a pair of hinge pins integrally molded with the occlusion bed which are received in lugs integrally molded with the base of the pump. The occlusion bed also preferably includes an integral resiliently-biased latch member which cooperates with a latch plate integrally molded in the base of the pump. The pump preferably includes a rotor in which each of the roller support pins is molded integrally with one of the end plates. To secure tubing in place on the pump, a pair of cantilevered leaf springs urge tubing into slots on tubing retainer plates disposed adjacent the rotor. The roller pins and rollers may be made of a low friction composite material which eliminates the need for bearings therebetween.

12 Claims, 5 Drawing Sheets

PERISTALTIC PUMP

BACKGROUND OF THE INVENTION

The invention relates generally to pumps, and more particularly to a peristaltic pump wherein a plurality of rollers disposed on a rotor successively engage one or more lengths of tubing to effect pumping of fluid therethrough.

In recent years, peristaltic pumps have proven to be well suited for many applications involving pumping of various fluids in laboratory, medical, and other applications. A particular advantage of peristaltic pumps is their ability to pump fluids through a continuous, unbroken length of tubing, without the fluid in the tubing contacting any components of the pump other than the tubing itself.

In many contexts, it is desirable to change tubing frequently in a particular pump. Various efforts have been made to enable removal and insertion of tubing with relatively little time and effort. For example, U.S. Pat. No. 5,082,429 and U.S. Pat. No. 4,231,725 disclose peristaltic pumps having movable occlusion beds which can be shifted between a closed, or operating position, and an open, or loading/unloading position, to facilitate changing of tubing. Other peristaltic pumps are illustrated in U.S. Patent Nos. 4,256,442; 5,133,650; 3,963,023; 5,110,270; 4,886,431; and 5,147,312.

The provision of a mechanism for quickly and easily opening the pump to permit loading and unloading of tubing, and closing the pump to permit peristaltic pumping, requires that several considerations be addressed. Among these are the fact that in the closed position, the occlusion bed must be stably supported in a desired spatial relationship to the rotor, notwithstanding relatively high dynamic pumping forces directed radially outward against the occlusion bed during pumping. The locking mechanism must be capable of withstanding such forces and operational loads without loosening, without excessive vibration, and without displacement that would adversely affect the ability to maintain precise control of pump flow rates. Any increase in the distance between the occlusion bed and the rotor changes the occlusion of the tubing, and can result in unacceptable variations in flow rates. Another consideration is the need for the pump to be capable of economical manufacture. Economic considerations are particularly important in the health care industry, where peristaltic pumps serve various roles, from administration of intravenous fluids requiring intermittent pumping at low flow rates, to blood analysis and other laboratory work requiring pumping at higher flow rates. In developing peristaltic pumps for such applications, the need for precision and reliability is, of course, paramount.

Another consideration in the design of peristaltic pumps is size and weight. Particularly in applications where the pump is to be incorporated as a component of a larger analytical unit or other piece of equipment, a pump manufacturer may need to comply with exacting specifications as to maximum pump dimensions, and maximum pump weight, while also complying with performance specifications, including the capability to pump at specified flow rates within specified flow rate tolerances.

A general object of the invention is to provide a compact, lightweight peristaltic pump which is capable of pumping at relatively high flow rates with a high degree of reliability and precision, and which is capable of economical manufacture. A further object is to provide a peristaltic pump having means to facilitate loading and unloading of tubing.

SUMMARY OF THE INVENTION

The invention generally comprises a peristaltic pump comprising a rotor having a plurality of rollers thereon, and an occlusion bed positioned in proximity to the rotor so that rotation of the rotor effects pumping of fluid through the tubing, with the occlusion bed reacting pumping forces.

In a preferred embodiment of the invention, the pump is constructed of a relatively small number of components so that high performance and reliability can be achieved in a relatively economical and compact pump. To this end, in accordance with a feature of the invention, the occlusion bed preferably pivots about a pair of hinge pins integrally molded with the occlusion bed which are received in lugs integrally molded with the base of the pump. In accordance with a further feature of the invention, the occlusion bed preferably includes an integral resiliently-biased latch member which cooperates with a latch plate integrally molded with the base of the pump to provide a snap-action lock mechanism for maintaining the occlusion bed stably in closed position during pumping, while permitting relatively quick and simple unlocking of the occlusion bed by application of manual pressure to the latch. In accordance with a further feature of the invention, the rotor preferably comprises a pair of end plates and a plurality of roller pins extending between the end plates for rotatably supporting rollers thereon, wherein each of the roller pins is formed integrally with one or the other of the end plates.

Employment of some or all of the above features in a peristaltic pump will facilitate assembly of the pump by reducing the number of parts as compared with many known prior art peristaltic pumps, while enabling relatively high flow rates to be achieved with precision and reliability.

In accordance with a further feature of the invention, the pump may include a novel tubing retainer mechanism comprising a stationary wall having a plurality of slots therein for engaging tubing, and at least one cantilevered leaf spring biased to urge the tubing toward the slot for securement therein, but capable of manual deflection away from the tubing for permitting loading and unloading of the tubing.

Further features and advantages of the invention will become apparent from the text set forth below and from the accompanying drawings.

DETAILED DESCRIPTION OF PREFERRED EMBODIMENT

Figure 1:
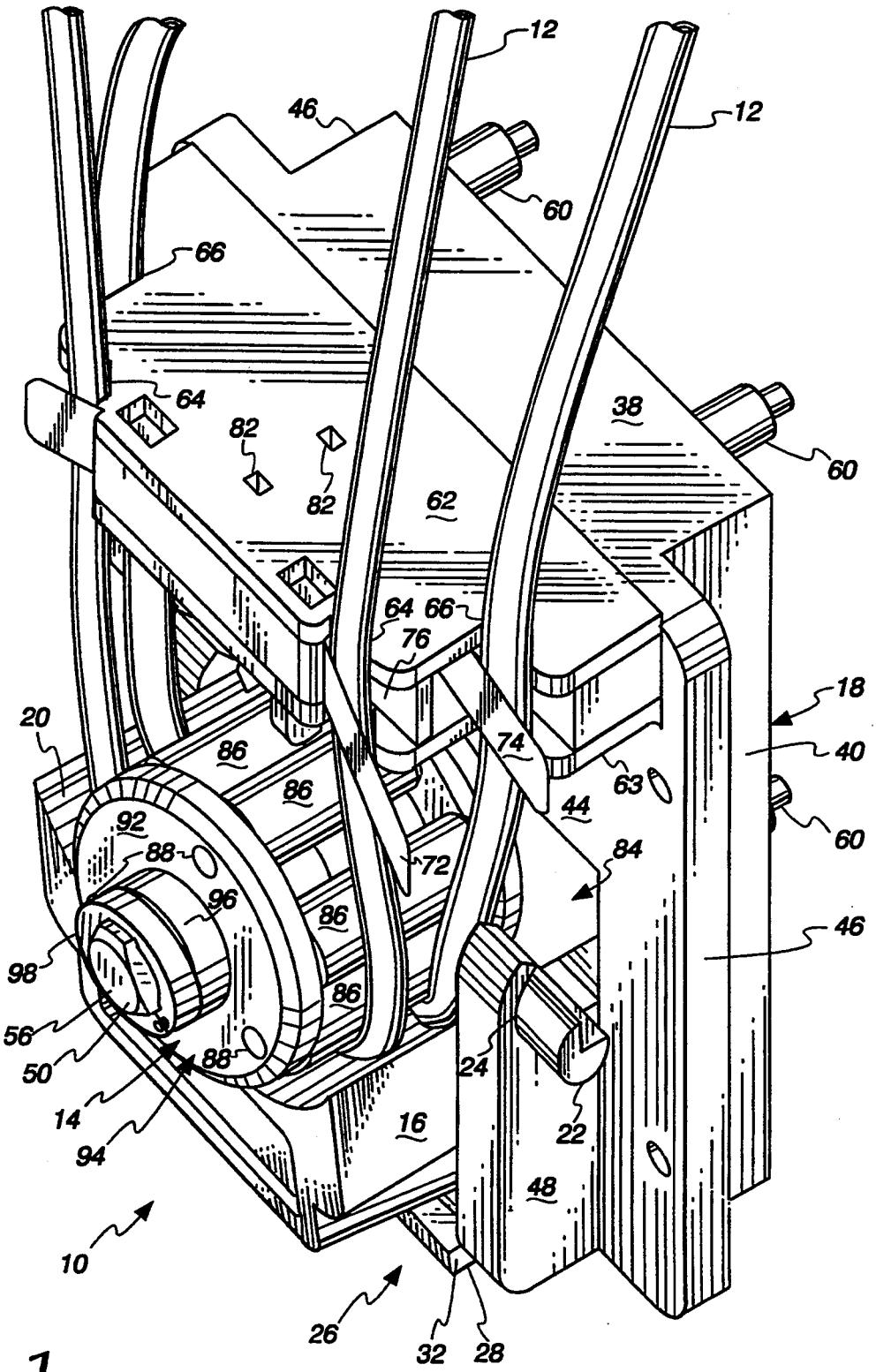
FIG. 1 is a perspective view of a peristaltic pump in accordance with a preferred embodiment of the invention.
Figure 2:
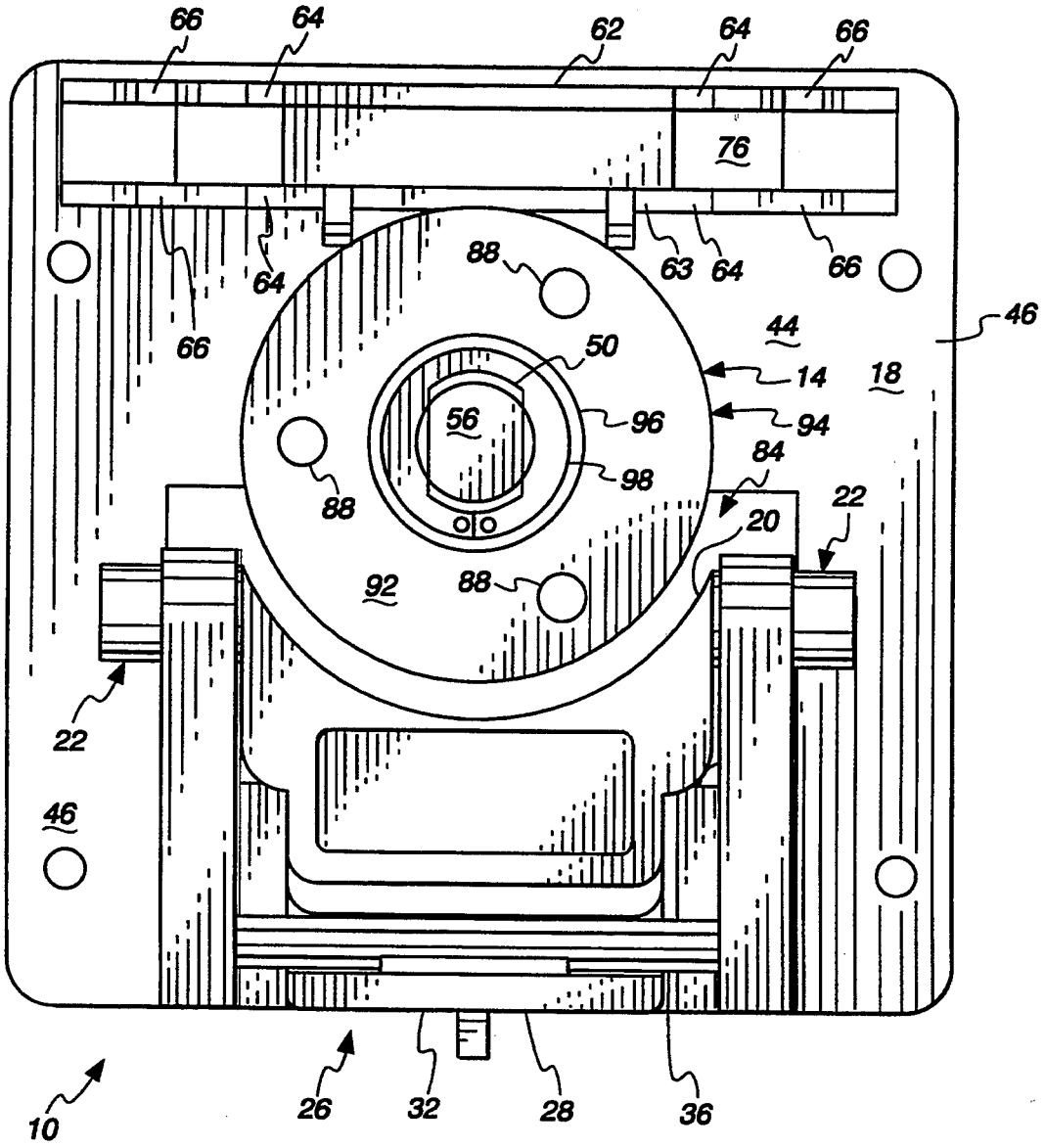
FIG. 2 is a front elevational view of the pump of FIG. 1.
Figure 3:
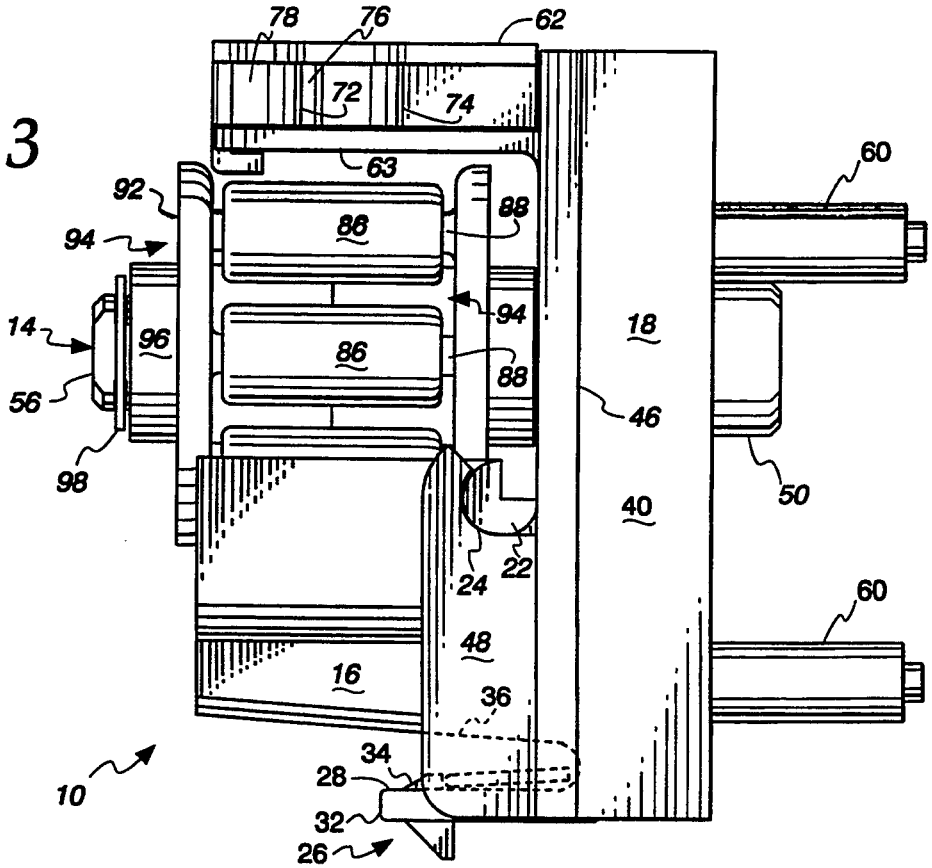
FIG. 3 is a side elevational view of the pump of FIG. 1.

The invention is preferably embodied in a peristaltic pump 10 in which one or more lengths of tubing 12 are secured between a rotor 14 and an occlusion bed 16 such that rotation of the rotor 14 effects displacement of fluid therethrough. In the illustrated embodiment, the occlusion bed 16 is pivotally supported on a base 18 so that it is movable between an open position (FIG. 4) in which it is spaced from the rotor 14 sufficiently to permit loading and unloading of tubing, and a closed position (FIG. 3) in which the occlusion bed is spaced from the rotor by a relatively small distance to enable peristaltic pumping to take place.

In the illustrated embodiment, the occlusion bed 16 pivots about a horizontal axis substantially perpendicular to the axis of the rotor 14. The occlusion bed 16 in the illustrated embodiment is a one-piece injection-molded structure comprising an occlusion surface 20 defining a predetermined radius for cooperation with the rotor 14 to effect pumping through the tubing 12, and further comprising a pair of integral hinge pins 22 extending outward on opposite sides thereof to support the occlusion bed for pivoting between its closed and open positions. Each of the hinge pins 22 has a substantially circular cylindrical exterior over about three-quarters of its circumference, and is engaged by and supported in a respective slot 24 on the base 18. The occlusion bed 16 preferably is formed with a plurality of rearwardly-opening cavities therein separated by ribs to reduce its mass and material requirements while providing stiffness and support for the occlusion surface.

Figure 4:
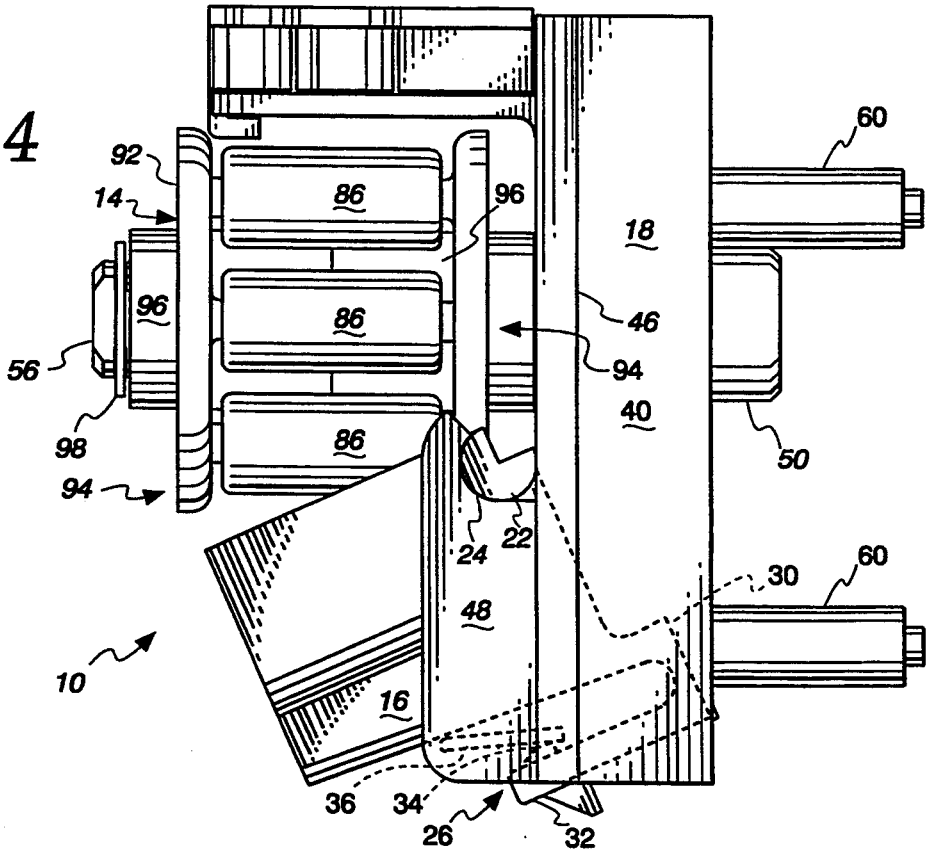
FIG. 4 is a side elevational view similar to FIG. 3, but showing the occlusion bed in open position.

The illustrated pump further comprises a lever-actuated snap-lock mechanism 26 for selectively maintaining the occlusion bed 16 in closed position during operation, while permitting manual release of the occlusion bed for displacement from the closed position to the open position when loading or unloading of tubing is desired. In the illustrated embodiment, the lever-actuated snap-lock mechanism 26 is disposed at the bottom of the occlusion bed, and comprises a flexible latch member 28 formed integrally with the occlusion bed and a fixed latch plate 36 on the base. The latch member has a generally L-shaped configuration, comprising a first wall 30 extending downward at the rear of the occlusion bed, and a second wall 32 extending forward from the bottom of the first wall and having a wedge-shaped protrusion 34 on the upper surface thereof for engaging the latch plate 36 on the base to cam the second wall 32 downward as the occlusion bed is pivoted to closed position, then lock the occlusion bed in closed position as the second wall 32 snaps upward. To unlock the occlusion bed so that it may be shifted to open position, the user manually deflects the second wall 32 of the latch member 28 downward, which releases the protrusion 34 from locking engagement with the latch plate 36 and additionally causes the occlusion bed to pivot toward the open position. The protrusion 34 then engages the lower surface of the latch plate to limit pivoting of the occlusion bed, as shown in FIG. 4. A relatively high amount of additional force is required to deflect the latch member 28 sufficiently to clear the rear edge of the latch plate 36 to permit the occlusion bed to be removed from the base. If desired, the occlusion bed can be so removed by application of such force and, after the latch member 28 has cleared the latch plate 36, the occlusion bed may then be lifted so that the hinge pins 22 clear their associated slots 24, and the occlusion bed may then be moved forward out of association with the base, provided that the rotor has first been removed.

The base 18 comprises a generally rectangular frame comprising a top wall 38, a pair of sidewalls 40 extending downward therefrom, and a bottom strut 42 connecting the lower ends of the sidewalls. The base 18 further comprises a front wall 44 which extends laterally beyond the sidewalls to define mounting flanges 46 for the base. To support the occlusion bed 16 for pivoting between open and closed position, the base 18 includes integral vertical lugs 48 extending forward of the front wall, with upwardly opening slots 24 to receive the hinge pin. The latch plate 36 extends between the lugs 48.

To support the rotor shaft 50 for rotation on the base 18, the base includes an integral stationary collar 52 of generally cylindrical configuration extending rearward from the front wall 44. Reinforcing ribs 54 extend generally outward from the collar to provide sufficient stiffness to enable the collar to stably support the shaft and react against forces normal to the shaft resulting from the pressure between the rollers and the occlusion bed. The rotor 14 is supported on a cantilevered portion of the shaft, which is unsupported at its forward end 56 opposite the front wall of the base. The base collar 52 is preferably provided with a suitable bronze bushing 58 or a suitable bearing to avoid wear on its interior surface.

The illustrated pump may be driven by a motor (not shown) disposed directly rearward of the base 18, and to facilitate attachment of the pump to a motor, four motor-mount bosses 60 are provided extending rearward from the base in a generally rectangular pattern near the corners thereof.

To secure lengths of tubing 12 in place on the pump, and to provide resistance to the tubing being drawn through the pump by the action of the rotor 14, a tubing retainer mechanism is provided. In the illustrated embodiment, the tubing retainer mechanism is configured to support two lengths of tubing 12 which may be disposed simultaneously in the pump. The tubing retainer mechanism comprises upper and lower generally horizontal walls 62 and 63 extending forward from the front wall 44 of the base above the rotor. Each has a forward surface having forward and rear pairs of slots 64 and 66 formed along its front edge to receive the tubing. The lower wall 63 is molded integrally with the base. The upper wall 62 is provided with rearwardly-extending barbed protrusions 68 for insertion in openings 70 in the front wall 44 of the base for securement of the upper wall therein.

To urge the tubing into its proper engagement with the slots, forward and rear leaf springs 72 and 74 are disposed between the upper and lower tubing retainer walls 62 and 63 with their ends positioned to urge the tubing into the slots 64 and 66. Each of the leaf springs is configured so that its ends may be individually pulled forward to enable tubing to be placed in engagement with the slot. Upon release, the ends of the springs urge the tubing into the slots and maintain it in place.

To secure the forward leaf spring 72 in place, a rib 76 depending from the upper wall 62 extends laterally across the tubing retainer immediately rearward of the forward spring, and a second rib 78 is disposed immediately forward of the forward spring at or near the center thereof. The rear leaf spring 74 is similarly constrained. Each of the leaf springs also has an integral, upwardly-extending tab 80 received in an opening 82 in the upper wall to constrain it against lateral displacement.

To permit pivoting of the occlusion bed 16, and to facilitate assembly of the pump 10, a relatively large opening 84 is provided in the base 18 below the collar 52. When the occlusion bed is pivoted to open position, its lower portion extends through the opening 84.

The rotor 14 in the illustrated embodiment of the invention generally comprises a plurality of rollers 86, the rotor shaft 50, and a pair of rotor members 94, each comprising an end plate 92, a plurality of roller support pins 88, and a collar 96 which has a noncircular bore for engagement with a complementary exterior surface of the shaft 50 to couple the rotor members 94 to the shaft for rotation therewith. In the illustrated embodiment, each of the members 94 is a one-piece, integral unit and has one-half of the rotor's roller support pins 88 integrally formed thereon. In the illustrated embodiment, in which the rotor comprises a total of six rollers, the members 94 have substantially the same configuration, and each of the members 94 has three roller support pins 88 integrally formed therewith and equally spaced from one another at 120° intervals. Each of the end plates further has openings equally spaced, midway between each adjacent pair of support pins 88 to receive the ends of the pins formed on the opposite associated end plate.

In the illustrated embodiment, the rollers 86 are in direct contact with their associated roller support pins 88, without bearings, bushings, or other components disposed between the roller and support pin. To enable a sufficiently low coefficient of friction to be maintained between the rollers and their associated support pins, the rollers and support pins are preferably manufactured from a composite material containing an internal lubricant such as polytetrafluoroethylene (PTFE). One particular material which is believed to be suitable for this application is a polyphenylenesulfide (PPS) material with PTFE and glass fill. The entire pump may be made of this material, with the exception of the leaf springs 72 and 74, rotor shaft 50, bushing 58, and clip 98.

The rotor shaft 50 preferably has an integral collar 96 of enlarged diameter thereon to bear on the rear surface of the bushing 58 and limit forward travel of the shaft 50. A bore and set screw or other suitable means may be provided at the rear end of the shaft to facilitate coupling to a motor shaft. To limit rearward travel of the shaft, a clip 98 may be disposed in a slot or groove at its forward end.

Figure 5:
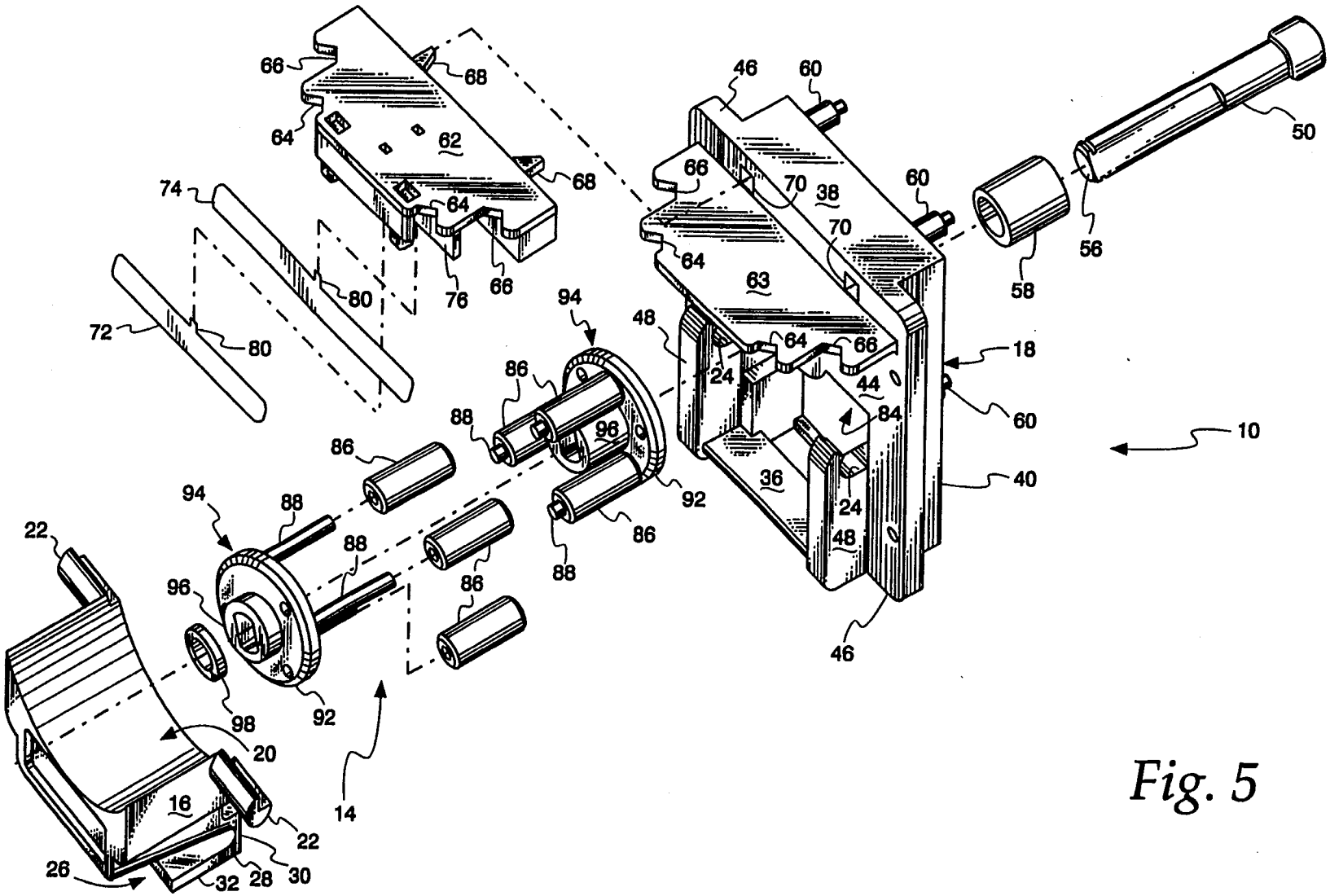
FIG. 5 is an exploded perspective view of the pump of FIG. 1.
Figure 6:
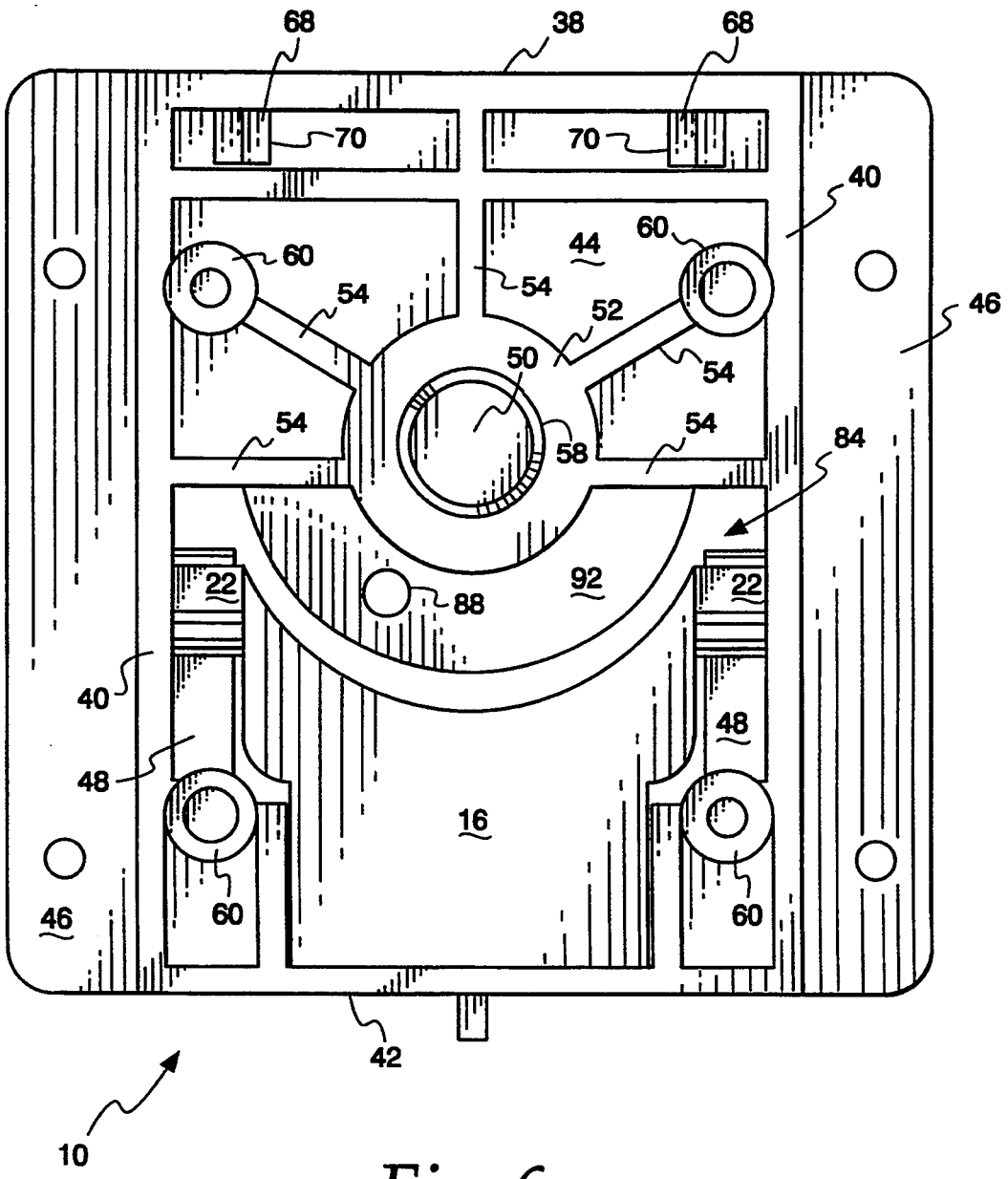
FIG. 6 is a rear elevational view of the pump of FIG. 1.

From the foregoing, it should be appreciated that the invention provides a novel and improved peristaltic pump. One feature of the illustrated pump is the relatively small number of parts, which facilitates manufacture and assembly. As best seen with reference to FIG. 5, the illustrated pump 10 comprises only sixteen parts. The base 18 is a one-piece, integral member, as is the occlusion bed 16. Each may be injection molded from a suitable composite material for high strength and light weight. Similarly, each of the rotor members 94 and rollers 86 is a one-piece, integral part which may be injection molded of a suitable composite material.

The pump may be assembled relatively simply by the following steps: The occlusion bed 16 is inserted rearward through the opening 84 in the front wall 44 of the base, and the hinge pins 22 are lowered into their associated slots 24 as the latch member 28 is flexed downward to enable it to slide past the rear edge of the latch plate 36. The bushing 58 is inserted into the fixed collar 52 on the base from the rear, and the rotor shaft 50 is inserted through the bushing. The rollers 86 are placed on the roller support pins 88 of their respective associated rotor members 94, and the rotor members 94 are thereafter snapped together, with the respective collars 96 abutting when the members 94 are in the proper assembled position relative to one another. The members 94 are placed on the rotor shaft. The clip is placed on the forward end of the shaft. The upper tubing retainer plate, with the leaf springs properly positioned thereon, is snapped into place on the front wall. The above assembly procedure may be contrasted with much longer and more complicated assembly procedures needed for many known prior art peristaltic pumps. Thus, the invention provides a pump which is not only capable of providing precise flow control over a relatively wide range of flow rates, but also is compact and economical to manufacture and assemble.

It should be noted that terms such as "above", "below", "horizontal", "vertical", etc., are used herein to describe spatial relationships and orientations of pump components relative to one another. These terms are not used with intent to limit the orientation in which the pump may be used, and indeed it is contemplated that the pump may be used in a variety of different orientations in addition to the specific orientation illustrated in the accompanying drawings. These terms are used herein only for convenience of description, and should be so interpreted.

The invention is not limited to the particular embodiment described hereinabove, but is particularly pointed out and distinctly claimed below.

What is claimed is:

1. A peristaltic pump comprising:

a base, a rotor supported on said base, said rotor comprising a support structure and a plurality of rollers mounted thereon; and an occlusion bed supported on said base so as to be pivotable about a fixed axis perpendicular to the axis of said rotor and adjacent said base between an open position in which said occlusion bed is spaced from said rotor by a relatively large distance to enable loading and unloading of tubing, and a closed position in which said occlusion bed is spaced from said rotor by a relatively small distance to enable peristaltic pumping upon rotation of said rotor, with only a minor angular displacement of said occlusion bed being needed to shift said occlusion bed between said open and closed positions;

wherein said occlusion bed is a one-piece structure comprising an integral latch lever, and wherein said base includes a latch plate for cooperation with said latch lever to provide a snap-action lock mechanism for selectively maintaining said occlusion bed in said closed position.

2. A peristaltic pump comprising:

a base;

a rotor supported on said base, said rotor comprising a support structure and a plurality of rollers mounted thereon; and an occlusion bed supported on said base so as to be movable between an open position in which said occlusion bed is spaced from said rotor by a relatively large distance to enable loading and unloading of tubing, and a closed position in which said occlusion bed is spaced from said rotor by a relatively small distance to enable peristaltic pumping upon rotation of said rotor wherein said occlusion bed is a one-piece structure comprising an integral latch lever, and wherein said base includes a latch plate for cooperation with said latch lever to provide a snap-action lock mechanism for selectively maintaining said occlusion bed in said closed position; and wherein said occlusion bed comprises a one-piece injection-molded member having a pair of axially aligned hinge pins extending outward on opposite sides thereof, and wherein said base comprises a pair of slots for receiving said hinge pins.

3. A peristaltic pump in accordance with claim 1 wherein said rotor support structure comprises a shaft and first and second end plates supported on said shaft, and a plurality of roller pins extending between said end plates for supporting said rollers, and wherein each of said roller pins is formed integrally with a respective one of said end plates.

4. A peristaltic pump comprising:

a base;

a rotor supported on said base, said rotor comprising a support structure and a plurality of rollers mounted thereon; and an occlusion bed supported on said base so as to be movable between an open position in which said occlusion bed is spaced from said rotor by a relatively large distance to enable loading and unloading of tubing and a closed position in which said occlusion bed is spaced from said rotor by a relatively small distance to enable peristaltic pumping upon rotation of said rotor, said occlusion bed comprising a one-piece member having a pair of axially aligned hinge pins formed integral therewith extending outward on opposite sides thereof to provide a pivot axis for movement of said occlusion bed between said open position and said closed position.

5. A peristaltic pump in accordance with claim 4 wherein said base comprises a pair of lugs integrally formed therewith and defining slots for receiving said hinge pins.

6. A peristaltic pump in accordance with claim 5 wherein said rotor comprises a shaft supported for rotation on said base, first and second end plates fixed to said shaft for rotation therewith, a plurality of roller pins extending between said end plates, and a plurality of rollers supported for rotation on said roller pins, each of said roller pins being formed integrally with a respective one of said end plate, each of said roller pins being in direct contact with its respective associated roller, said roller pins and rollers being respectively formed of a low friction material to enable rotation of said rollers on said roller pins without the necessity of intermediate bearings for rotatable support.

7. A peristaltic pump comprising:

a base;

an occlusion bed supported on said base and comprising an occlusion surface; and a rotor supported on said base, said rotor comprising a shaft, a pair of end plates disposed generally transversely of said shaft and fixed thereto for rotation therewith, a plurality of roller supports extending between said end plates, and a plurality of rollers supported on said roller supports;

wherein said rotor comprises a pair of identical pieces, each of said identical pieces comprising an end plate formed integrally with one-half of said roller supports.

8. A peristaltic pump in accordance with claim 7 wherein each of said rollers and each of said roller supports comprises a material having a low coefficient of friction, and wherein no bearings are employed to support said rollers for rotation on said roller supports.

9. A peristaltic pump comprising:

a base;

a rotor supported on said base, said rotor comprising a support structure and a plurality of rollers mounted thereon;

an occlusion bed providing an occlusion surface for cooperation with said rotors in effecting peristaltic pumping; and a tubing retainer supported on said base, said tubing retainer comprising a wall having a plurality of slots therein for receiving tubing, and at least one cantilevered leaf spring having at least one end portion movable between a closed position for retaining tubing in position, and an open position for permitting loading and unloading of tubing, said leaf spring being biased toward said closed position, said leaf spring being positioned to engage said tubing when in said closed position to maintain said tubing in its desired position.

10. A peristaltic pump in accordance with claim 9 wherein said occlusion bed is supported on said base so as to be movable between an open position in which said occlusion bed is spaced from said rotor by a relatively large distance to enable loading and unloading of tubing, and a closed position in which said occlusion bed is spaced from said rotor by a relatively small distance to enable peristaltic pumping upon rotation of said rotor, said occlusion bed being a one-piece structure comprising an integral latch lever, said base including a latch plate for cooperation with said latch lever to provide a snap-action lock mechanism for selectively maintaining said occlusion bed in said closed position.

11. A peristaltic pump in accordance with claim 10 wherein said occlusion bed comprises a pair of integral axially aligned hinge pins extending outward on opposite sides thereof, and wherein said base includes a pair of integral lugs defining slots for receiving said hinge pins.

12. A peristaltic pump in accordance with claim 11 wherein said rotor support structure comprises a shaft and first and second end plates supported on said shaft, and a plurality of roller pins extending between said end plates for supporting said rollers, and wherein each of said roller pins is formed integrally with a respective one of said end plates.

* * * * *